US012338734B1

(12) United States Patent
Ringgenberg

(10) Patent No.: US 12,338,734 B1
(45) Date of Patent: Jun. 24, 2025

(54) LOW EMISSION MULTI-ZONE HYDROCARBON RESERVOIR TESTING

(71) Applicant: Halliburton Energy Services, Inc., Houston, TX (US)

(72) Inventor: Paul D. Ringgenberg, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/394,613

(22) Filed: Dec. 22, 2023

(51) Int. Cl.
*E21B 49/08* (2006.01)

(52) U.S. Cl.
CPC ..... *E21B 49/088* (2013.01); *E21B 49/0875* (2020.05)

(58) Field of Classification Search
CPC .... E21B 49/088; E21B 49/0875; E21B 49/08; E21B 49/084; E21B 49/10
See application file for complete search history.

(56) References Cited

U.S. PATENT DOCUMENTS 2,675,080 A * 4/1954 Williams ..... E21B 33/1246 166/241.1
2,813,587 A * 11/1957 Mounce ..... E21B 49/084 166/243
5,220,829 A * 6/1993 Manke ..... F04C 13/008 166/264
6,325,146 B1 * 12/2001 Ringgenberg ..... E21B 43/129 166/264
8,116,980 B2 2/2012 Beretta et al.
8,620,636 B2 12/2013 Zhan et al.
8,776,591 B2 7/2014 Le Foll et al.
9,790,767 B2 10/2017 Zhou
9,957,786 B2 5/2018 Allen et al.
2011/0017448 A1 * 1/2011 Pipchuk ..... E21B 49/00 166/241.5
2024/0141782 A1 * 5/2024 Javed ..... E21B 49/081

FOREIGN PATENT DOCUMENTS

WO WO2015134565 A1 9/2018

OTHER PUBLICATIONS

Katie Mazerov, Open hole Applications Testing Multi-Zone Completions, Expandable tools to New Limits. Drilling Contractor Jul./Aug. 2010, pp. 74-78.

* cited by examiner

*Primary Examiner* — Brad Harcourt
(74) *Attorney, Agent, or Firm* — Conley Rose, P.C.; Rodney B. Carroll

(57) ABSTRACT

This disclosure relates to tool string embodiments, system embodiments, and method embodiments for testing and/or sampling a formation in an open hole hydrocarbon well, for example in order to determine whether the well merits production. Disclosed embodiments can be concerned with minimizing hydrocarbon emissions during testing, for example to provide a greener testing approach. Thus, improvements to reservoir testing a hydrocarbon well are disclosed.

20 Claims, 2 Drawing Sheets

LOW EMISSION MULTI-ZONE HYDROCARBON RESERVOIR TESTING

FIELD

The present disclosure relates generally to oil and gas reservoir testing, and more particularly, to testing of hydrocarbon reservoirs to evaluate whether a well is worth producing.

BACKGROUND

Hydrocarbon wells can be extremely costly to produce. Accordingly, it is often advisable to test the formation before taking the well all the way to production (e.g. for extraction of hydrocarbons from the reservoir/formation). For example, samples of the formation fluid can be removed from the well for analysis, which may provide valuable information in assessing the formation and the potential productivity of the well. Typically, a wireline tool may be used for testing, and testing may occur while drilling mud is also simultaneously pumped in the well. This can dilute the hydrocarbons in any sample, reducing the effectiveness of the testing. Additionally, the samples are typically brought to the surface during the process, separated and metered at the surface, and then all products are burned off by flaring. Such a process releases carbon emissions, which can have unwanted environmental impact. Furthermore, some nations forbid such practices or require a costly carbon tax for such practices. For at least one or more of these reasons, there may be a need for an improved process for testing hydrocarbon reservoirs.

BRIEF DESCRIPTION OF THE DRAWINGS

Embodiments of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description.

As used herein the terms "uphole", "upwell", "above", "top", "upper" and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. For example, the terms "uphole" and "downhole" may be used to describe the location of various components of a well testing system 100 relative to the bottom or end of wellbore 108 shown in FIG. 1. For example, a first component described as uphole from a second component may be further away from the end of wellbore 108 (e.g. closer to the surface) than the second component. Similarly, a first component described as being downhole from a second component may be located closer to the end of wellbore 108 (e.g. further from the surface) than the second component. Terms like up, down, top, bottom, above, and below similarly relate to descriptions relative to uphole and downhole directions.

Figure 1:
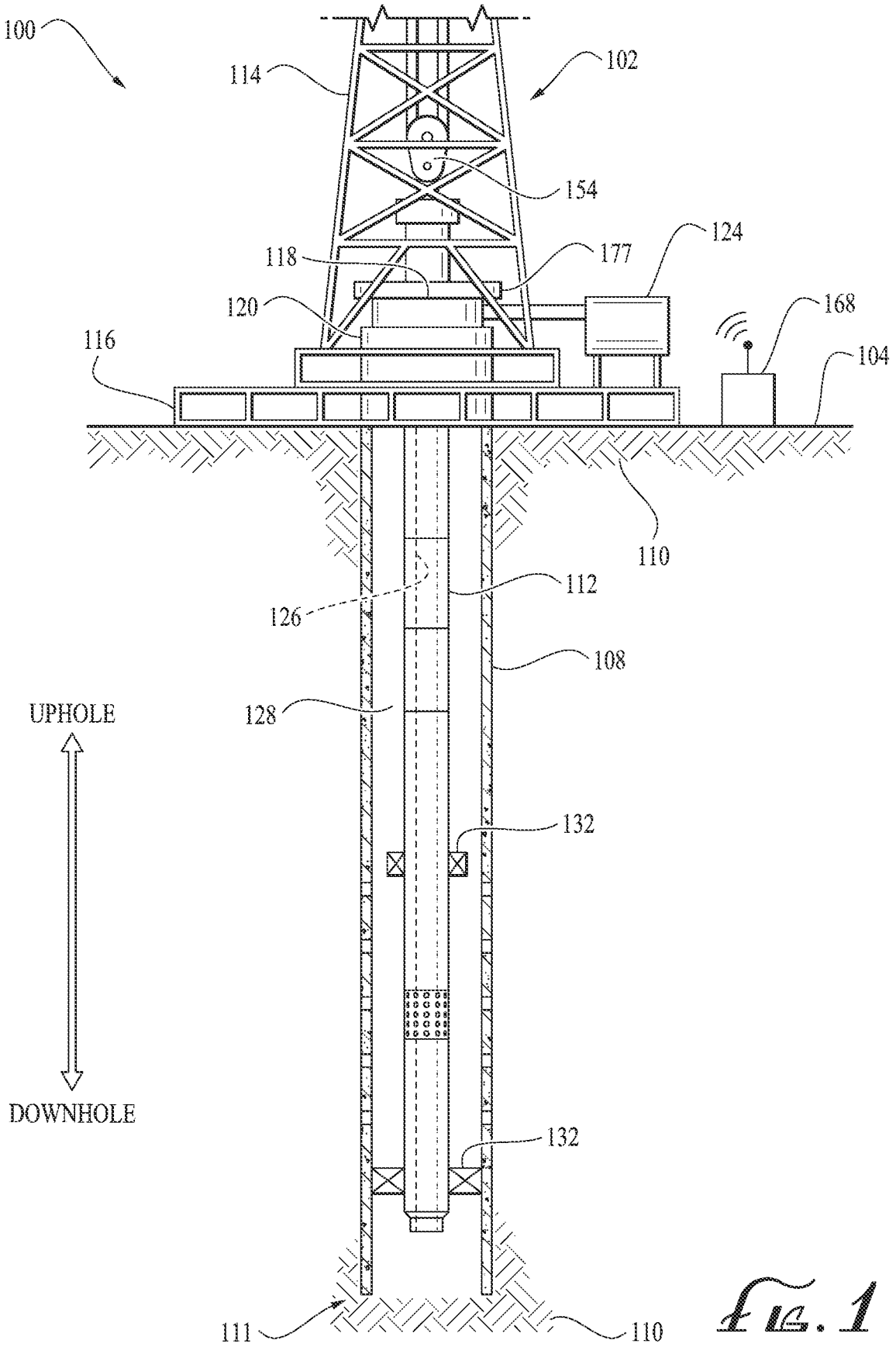
FIG. 1 illustrates a schematic elevation view of an exemplary well in which an exemplary tool string has been deployed, according to embodiments of this disclosure.

FIG. 1 illustrates a schematic, elevation view of an exemplary embodiment of a tool string 112 disposed within an exemplary well. While the operating environment is shown in FIG. 1 with respect to a stationary, land-based rig for raising, lowering, and setting a tool string 112, in alternative embodiments, mobile rigs, wellbore servicing units, and the like may be used to lower the tool string 112 into the well. Furthermore, while the operating environment is generally discussed as relating to a land-based well, the systems and methods described herein may instead be operated in subsea well configurations, for example accessed by a fixed or floating offshore platform, drill ships, semi-submersibles, and/or drilling barges. Additionally, while wellbore 108 is shown as being a generally vertical wellbore, wellbore 108 may be or include any orientation, including generally horizontal, multilateral, or angularly directional. For example, in some embodiments the wellbore 108 may have a substantially vertical portion (e.g. extending downward from the surface 104) and a substantially horizontal portion (e.g. extending from the substantially vertical portion approximately horizontally).

FIG. 1, illustrates an exemplary well testing system 100. The well testing system 100 can includes a rig 102 atop a surface 104 of a well having a wellbore 108. Beneath the rig 102, the wellbore 108 is formed within a geological formation 110, which may be expected to produce hydrocarbons or other fluids (e.g. with the formation 110 including a reservoir of hydrocarbon/formation fluids). By way of example, the wellbore 108 may be formed in the geological formation 110 using a drill string that includes a drill bit to remove material from the geological formation 110. The wellbore 108 of FIG. 1 is shown as being near-vertical, but may for example be formed at any suitable angle to reach a hydrocarbon-rich portion of the geological formation 110. In some embodiments, the wellbore 108 may follow a vertical, partially-vertical, angled, or even a partially-horizontal path through the geological formation 110, extending from the surface 104 to an exemplary toe 111.

As shown in FIG. 1, a tool string 112 can be deployed from the rig 102. In embodiments, the rig 102 can include a derrick 114 and a rig floor 116. The tool string 112 in FIG. 1 penetrates a rotary table 177 and may then extend downward through the rig floor 116, through a fluid diverter 118 and blowout preventer 120 (which may be configured as or include a nipple in some embodiments) that provide a fluidly sealed interface between the wellbore 108 and external environment, and into the wellbore 108 and geological formation 110. In drilling operations, for example, the tool string 112 may be rotated by the rotary table 177. The tool string 112 is shown in installed/deployed position in FIG. 1. However, prior to, during, or following installation, the well testing system 100 may also include a conveyance mechanism such as a motorized winch 154 and/or other equipment for extending the tool string 112 into the wellbore 108, retrieving the tool string 112 from the wellbore 108, positioning the tool string 112 at a selected depth within the wellbore 108, etc.

In some embodiments, a surface pump 124 can be coupled to the fluid diverter 118. The surface pump 124 may be operational to deliver or receive fluid through a fluid bore 126 (e.g. longitudinal bore) of the tool string 112 by applying a positive or negative pressure to the fluid bore 126. For example, the surface pump 124 may be configured to deliver mud (e.g. drilling mud or other drilling fluid) into the fluid bore 126 of the tool string 112, for example pumping mud under pressure from a mud pit into the tool string 112. In FIG. 1, the pump 124 is disposed at the surface 104. Although not explicitly shown herein, in some embodiments a pump may be disposed within the wellbore 108. For example, a rotation-operated formation pump may be disposed downhole, as discussed in greater detail below. As referenced herein, the fluid bore 126 may provide the flow path of fluid from an inlet of the tool string 112 (e.g. downhole in the well) to the surface 104. In some embodiments, the pump 124 (and/or any additional pump) may also deliver positive or negative pressure through an annulus 128 formed between the wall of the wellbore 108 and an exterior of the tool string 112. In FIG. 1, the annulus 128 is formed between the tool string 112 and the wall of the open wellbore (e.g. uncased wellbore) when tool string 112 is disposed within the wellbore 108.

In some embodiments, the system 100 may include a (e.g. surface) control system 168 and/or a processor (e.g. which may be disposed within the tool string 112). For example, the control system 168 may be configured to control the conveyance mechanism (e.g. winch 154) in order to position the tool string 112 within the wellbore 108. In some embodiments, the control system 168 may be configured to receive data regarding depth, for example from one or more sensor (such as the gamma detector 215 discussed below as part of an exemplary tool string 112), to evaluate the data, and responsive to the evaluation, to control the conveyance mechanism to control the depth of the tool string 112 in the wellbore 108. For example, the control system 168 may be configured to receive sensor data via mud pulse in some embodiments. In some embodiments, the control system 168 may be configured to operate the rotary table 177 and/or top drive, for example to rotate the tool string 112.

The control system 168 may include an information handling system (e.g. comprising one or more processor) and/or may be configured to receive data from one or more sensor configured to monitor/detect one or more parameters of the system. Data from the sensor(s) may be transmitted to and/or received by the information handling system, for example with the control system 168 using the data to monitor and/or control one or more aspect of the system 100. In embodiments, the control system 168 may be configured to communicate with sensors and/or other components of the system wirelessly and/or via wired connection.

An exemplary information handling system/control system 168, for example for use with or by an associated system 100 of FIG. 1, is set forth below, according to one or more aspects of the present disclosure. A processor or central processing unit (CPU) of the control system 168 is communicatively coupled to a memory controller hub (MCH) or north bridge. The processor may include, for example a microprocessor, microcontroller, digital signal processor (DSP), application specific integrated circuit (ASIC), or any other digital or analog circuitry configured to interpret and/or execute program instructions and/or process data. The processor may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory or hard drive. Program instructions or other data may constitute portions of a software or application, for example application or data, for carrying out one or more methods described herein. Memory may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application or data may be retrieved and stored in memory for execution or use by processor. In one or more embodiments, the memory or the hard drive may include or comprise one or more non-transitory executable instructions that, when executed by the processor, cause the processor to perform or initiate one or more operations or steps. The information handling system may be preprogrammed or it may be programmed (and reprogrammed) by loading a program from another source (for example, from a CD-ROM, from another computer device through a data network, or in another manner).

The data may include testing data (e.g. such as depth of the tool string 112), treatment data, geological data, fracture data, microseismic data, sensor data, or any other appropriate data. In one or more embodiments, the data may include data relating to testing/sampling plans. In one or more embodiments, the data may include geological data relating to one or more geological properties of the subterranean formation. For example, the geological data may include information on the wellbore, completions, or information on other attributes of the subterranean formation. In one or more embodiments, the geological data may include information on the lithology, fluid content, stress profile (e.g., stress anisotropy, maximum and minimum horizontal stresses), pressure profile, spatial extent, gamma radiation profile of the well, or other attributes of one or more rock formations in the subterranean zone. The geological data may include information collected from well logs, rock samples, outcroppings, microseismic imaging, or other data sources. In one or more embodiments, the data may include fracture data relating to fractures in the subterranean formation. The fracture data may identify the locations, sizes, shapes, and other properties of fractures in a model of a subterranean zone. The fracture data may include information on natural fractures, hydraulically-induced fractures, or any other type of discontinuity in the subterranean formation. The fracture data may include fracture planes calculated from microseismic data or other information. For each fracture plan, the fracture data may include information (for example, strike angle, dip angle, etc.) identifying an orientation of the fracture, information identifying a shape (for example, curvature, aperture, etc.) of the fracture, information identifying boundaries of the fracture, or any other suitable information. In embodiments, the data may include a gamma radiation profile/map of the well.

In embodiments, the sensor data may include data measured/detected by one or more sensors, for example with relation to one or more aspect of the tool string 112 and/or the system 100. For example, the sensor data may include pressure, temperature, flow rate, viscosity, contamination/particle count, strain, and/or fluid type (e.g. identifying the type of fluid, for example as mud and/or formation fluid). Data received by the control system 168 (e.g. from one or more sensors) may be used to carry out operations with respect to the tool string 112 and/or system 100. For example, the control system 168 may evaluate the data and determine one or more action based on the evaluation. In some embodiments, the control system 168 may automatically take action based on the evaluation.

The one or more applications may comprise one or more software applications, one or more scripts, one or more programs, one or more functions, one or more executables, or one or more other modules that are interpreted or executed by the processor. For example, the one or more applications may include a fracture design module, a reservoir simulation tool, a hydraulic fracture simulation model, or any other appropriate function block. The one or more applications may include machine-readable instructions for performing one or more of the operations related to any one or more embodiments of the present disclosure. The one or more applications may include machine-readable instructions for generating a user interface or a plot, for example, illustrating fracture geometry (for example, length, width, spacing, orientation, etc.), pressure plot, hydrocarbon production performance, pump performance. The one or more applications may obtain input data, such as treatment data, geological data, fracture data, or other types of input data, from the memory, from another local source, or from one or more remote sources (for example, via the one or more communication links). The one or more applications may generate output data and store the output data in the memory, hard drive, in another local medium, or in one or more remote devices (for example, by sending the output data via the communication link).

Memory controller hub may include a memory controller for directing information to or from various system memory components within the information handling system, such as memory, storage element, and hard drive. The memory controller hub may be coupled to memory and a graphics processing unit (GPU). Memory controller hub may also be coupled to an I/O controller hub (ICH) or south bridge. I/O controller hub is coupled to storage elements of the information handling system, including a storage element, which may comprise a flash ROM that includes a basic input/output system (BIOS) of the computer system. I/O controller hub is also coupled to the hard drive of the information handling system. I/O controller hub may also be coupled to an I/O chip or interface, for example, a Super I/O chip, which is itself coupled to several of the I/O ports of the computer system, including a keyboard, a mouse, a monitor (or other display) and one or more communications link. Any one or more input/output devices receive and transmit data in analog or digital form over one or more communication links such as a serial link, a wireless link (for example, infrared, radio frequency, or others), a parallel link, or another type of link. The one or more communication links may comprise any type of communication channel, connector, data communication network, or other link. For example, the one or more communication links may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to the exemplary control system 168 described herein without departing from the scope of the present disclosure. For example, any suitable configurations of components may be used. In embodiments, components of control system 168 may be implemented either as physical or logical components. Furthermore, in some embodiments, functionality associated with components of control system 168 may be implemented in special purpose circuits or components. In other embodiments, functionality associated with components of control system 168 may be implemented in configurable general-purpose circuit or components. For example, components of control system 168 may be implemented by configured computer program instructions. In embodiments, any processor embodiments (e.g. disposed within the tool string 112) may have one or more similar components and/or configuration to the description of the control system embodiments above.

Following formation of the wellbore 108 (e.g. by drilling), the tool string 112 may be equipped with tools and deployed within the wellbore 108 to prepare, operate, or maintain the well 106. For example, as will be discussed in more detail below, the tool string 112 may be configured for well testing. Typically, the tool string 112 may be conveyed/deployed into the wellbore 108 and thereby moved and positioned downhole within the wellbore 108 by the conveyance mechanism. For example, the conveyance mechanism may include drill pipe (e.g. tubing) extending downhole in some embodiments. In some embodiments, the tool string 112 may incorporate tools that can be actuated after deployment in the wellbore 108. For example, the tool string 112 may include one or more packer 132. The packer 132 generally remains in the first (e.g. run-in) state as it is run into the wellbore 108 for installation and until the packer 132 is actuated and set within the wellbore 108. Upon actuation, the expandable sealing element of the packer 132 may extend radially (e.g. to the second, set state), for example to engage and form a seal against the wellbore wall.

In some embodiments, actuation of the packer 132 may result in approximate centering of the tool string 112 within the wellbore 108, anchoring the tool string 112, isolating a segment or zone of the wellbore 108 from other segments or zones, and/or other functions related to positioning and operating the tool string 112. In the illustrative embodiment shown in FIG. 1, the tool string 112 is depicted with two packers 132 (e.g. an upper packer disposed uphole and a lower packer disposed downhole) for isolating segments of the wellbore 108. In FIG. 1, the exemplary upper packer 132 is shown in its first (e.g. run-in or contracted) state and the exemplary lower packer 132 is shown in its second (e.g. expanded/set) state to form a seal against the wall of the wellbore 108 and the tool string 112 to prevent fluids from regions in the formation 110 below the packer 132 from interacting with the tool string 112 thereabove.

Figure 2:
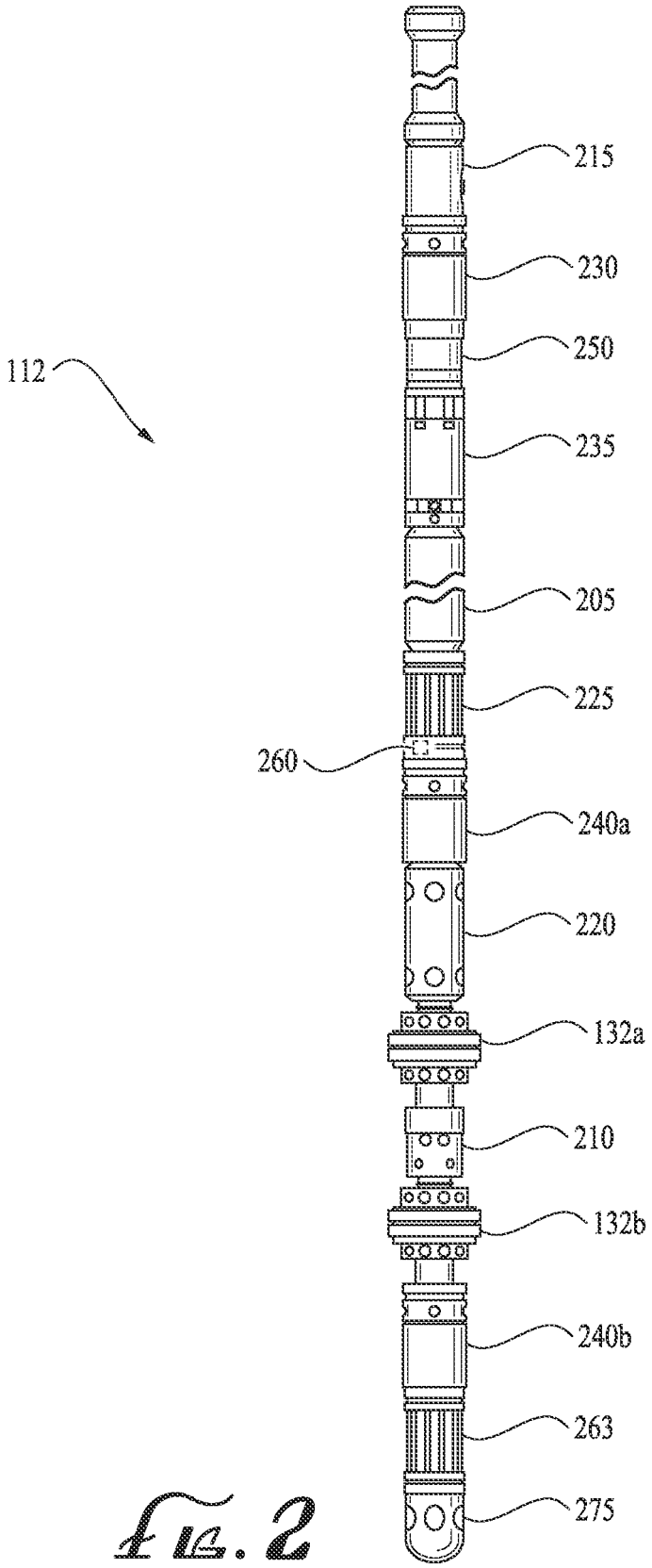
FIG. 2 illustrates schematically an example tool string, which may be configured for low-emission testing, according to an embodiment of this disclosure.

In embodiments, the tool string 112 may also include one or more other tools (e.g. in addition to the packers 132), for example for well testing a hydrocarbon formation. FIG. 2 illustrates an exemplary tool string 112 (e.g. a workstring) configured for well testing. For example, the tool string 112 of FIG. 2 can include a rotation-operated pump 205 (e.g. which is configured to be driven by rotation of the tool string 112, for example using a rotary table and/or top drive), a ported flow sub 210 (e.g. which may be configured so that when open, it allows fluid communication between the formation and the bore 126 of the tool string 112), two packers 132 disposed about the ported flow sub (e.g. with an upper packer 132*a* disposed above the ported flow sub 210 and a lower packer 132*b* disposed below the ported flow sub 210), and/or a gamma detector 215 (e.g. configured to detect gamma radiation (e.g. for location/depth determination) and to transmit data regarding detected gamma radiation uphole (e.g. to the surface control system 168), for example via mud pulse).

In some embodiments, the rotation-operated pump 205 may be configured for bypass, for example configured to allow fluid pumped downhole from the surface (e.g. using a surface pump 124) to flow around the rotation-operated pump 205 downhole towards the ported flow sub 210. By way of example, the bypass of the rotation-operated pump 205 may comprise a bypass pathway and a one-way valve such as a check valve, which may be configured to prevent passage (e.g. through the bypass pathway) of fluid flowing uphole, but to allow passage (e.g. through the bypass pathway) of fluid downhole. In embodiments, the rotation-operated pump 205 may comprise a mud pump configured to be powered by rotation of the tool string 112. For example, the pump 205 may comprise a progressive cavity pump or similar debris resistant pump.

As discussed above, the packers 132 may be configured to provide (e.g. in the set/inflated state) a seal between the outside of the tubing that forms the tool string 112 and a wellbore wall. For example, setting the packer 132 may cause the packer 132 to expand in a radial direction, for example to form a seal against the wellbore wall. In some embodiments, the tool string 112 may further comprise a packer isolation valve 220 having an open configuration and a closed configuration. In the open configuration, the packer isolation valve 220 may allow setting/inflation of the packers 132, and in the closed configuration, the packer isolation valve 220 may retain fluid within the packers 132 (e.g. to maintain inflation). In some embodiments, the packer isolation valve 220 may be configured to allow inflation of the packers 132 using fluid (e.g. mud) pumped downhole in a bore 126 of the tool string 112. For example, the packer isolation valve 220 may divert fluid (e.g. mud) from the bore 126 into the packers 132 when in the open configuration (e.g. for inflation of the packers 132), for example blocking flow downhole through the bore while opening fluid communication between the bore 126 and the packers 132. In the closed configuration, the packer isolation valve 220 may prevent fluid communication between the packers 132 and the bore 126 of the tool string 112 (e.g. retaining fluid in the packers 132 for inflation).

Some embodiments may further comprise a sampling sub 225, which may be configured to take a sample of the formation fluid. For example, some embodiments of the sampling sub 225 may be configured to store such a sample for extraction once the tool string 112 has been removed from the well, with the sample being later analyzed (for example offsite). In some embodiments, the sampling sub 225 may be configured to draw a sample of fluid from the bore 126 (e.g. at the appropriate time, such as after pumping of fluid uphole has cleared mud beyond the sampling sub 225 so that only clean formation fluids may be sampled). In some embodiments, the sampling sub 225 may be configured to take and retain a plurality of fluid samples, for example at different locations in the well. For example, the sampling sub 225 may include more than one sample chamber, with each sample chamber configured to retain one fluid sample. In some embodiments, more than one sampling sub 225 may be included in the tool string 112. In some embodiments, the sampling sub 225 may further be configured to detect pressure (e.g. comprising one or more pressure sensor). In some embodiments, the sampling sub 225 may comprise one or more sensor configured to determine if clean formation fluid is present, or if some amount of mud is present (e.g. the fluid is dirty or diluted with mud). In some embodiments, the sampling sub 225 may have a sample chamber extending approximately to the surface (e.g. a larger sample chamber than conventional). In some embodiments, the sample size for the sample chamber could be approximately 12 gallon of volume per foot of well depth. So for example, a 10,000 ft. well could have a 5,000 gallon sample chamber. In some embodiments, the fluid sample can be taken autonomously by the sampling sub 225 (e.g. with a processor 260 downhole identifying clean flow of formation fluid (e.g. with one or more fluid property sensed and holding static) or after a preselected time of pumping which may be indicative of clean flow). For example, the processor and/or sensor(s) may be disposed in the sampling sub 225. In some embodiments, the sampling sub could be configured as a complete sample analysis sub (e.g. with sophisticated sensors configured to identify the make-up of the fluid sample and/or the hydrocarbon's present and/or the compositional proportions, for example providing laboratory grade optical analysis downhole and/or in real time), such that no sample may be needed for later analysis in a lab. For example, this might include Halliburton's ICE technology to identify the hydrocarbons present.

Some tool string 112 embodiments may further comprise a circulating valve 230, which may be configured to control circulation/flow of fluids in and/or through the bore 126. For example, the circulating valve 230 may control circulation/flow of formation fluids uphole and/or control circulation/flow of formation fluids back downhole, for example by controlling flow of fluids in the bore 126. In some embodiments, the circulating valve 230 may prevent fluid flow upward and/or downward beyond the circulating valve 230 in the bore 126 and/or allow (e.g. when open) flow radially between the bore 126 and the annulus 128 around the tool string 112 (e.g. to allow flow uphole beyond the circulating valve 230 in the annulus when open). In some embodiments, when the circulating valve 230 is closed, there may be no flow of fluid in either direction past the circulating valve 230. In some embodiments, when the circulating valve 230 is open, there may be fluid flow past the circulating valve, for example by diversion of flow between the bore 126 and the annulus 128.

Some tool string 112 embodiments may further comprise a formation isolation valve 235, which may be configured to open and close fluid communication between the formation and the bore 126, for example through the ported flow sub 210. The formation isolation valve 235 may be configured to operate in conjunction with the ported flow sub 210. For example, when the formation isolation valve 235 is closed, there may be no fluid communication between the formation and the bore 126 of the tool string 112 through the ported flow sub 210; when the formation isolation valve 235 is open, there may be fluid communication between the formation and the bore 126 of the tool string 112 through the ported flow sub 210.

Some tool string 112 embodiments may further comprise one or more equalizing sub 240, which may be configured to reduce loading on the packers 132 (e.g. due to pressure imbalance. In FIG. 2, there are two equalizing subs 240, with a first equalizing sub 240*a* located above the upper packer 132*a* and a second equalizing sub 240*b* located below the lower packer 132*b*. Some tool string 112 embodiments may further comprise a plug catcher and launcher 250 which may be configured to separate formation fluid from mud (e.g. in the bore 126). For example, the plug catcher and launcher 250 may comprise a wiper plug, a base element (e.g. with a passage therethrough which may be in fluid communication with the bore 126 and which may be configured to catch the wiper plug, for example to prevent its passage further downhole in the bore 126), and a bypass passage (e.g. around or through the base element) having a one-way valve such as a check valve configured to allow passage of fluid therethrough only downhole. The wiper plug may be configured to move uphole in the bore 126 (e.g. above the base element) when fluid is pumped uphole, but to be caught and prevented from moving downhole beyond the plug catcher and launcher 250 when fluid is pumped downhole in the bore 126 (e.g. and through the bypass passage of the plug catcher and launcher 250 into the bore 126 below the base element and then further downhole). In some embodiments, the plug catcher and launcher 250 may be disposed above the rotation-operated pump 205 and/or above the formation isolation valve 235 and/or below the circulating valve 230. In some embodiments, the tool string 112 may have an approximately constant bore/pipe size (e.g. at least from the plug catcher and launcher 250 to the circulating valve 230, or in some embodiments to the surface). In some embodiments, the wiper plug of the plug catcher and launcher 250 may not move uphole beyond the circulating valve 230. In some embodiments, the wiper plug of the plug catcher and launcher 250 may be configured to interact with the circulating valve 230, for example operating the circulating valve 230 to an open position based on contact and/or assisting in diverting fluid flow through the circulating valve 230.

Some tool string 112 embodiments further comprise a processor 260, which may for example be configured to evaluate detected/sensed data (e.g. from one or more sensors) to determine clean flow of formation fluid (e.g. based on one or more sensor configured to identify the fluid (e.g. to determine if the fluid is clean formation fluid which is undiluted by mud) or based on a preselected time to initiate testing, evaluation, and/or sampling). In embodiments, the processor 260 may be disposed in the sampling sub 225 (although in other embodiments, the processor 260 can be located in any other element/sub of the tool string 112). In embodiments, the one or more sensor may comprise one or more sensor configured to detect/sense, for example the type of fluid (e.g. to distinguish between mud and formation fluid), at one or more location of the tool string 112. When drilling the well, it is common to lose some drilling fluid into the formation. In some embodiments, the one or more sensor should be able to monitor the fluid removed from the formation to determine when actual formation fluid is being produced (e.g. and not drilling mud). In some embodiments, the gamma detector 215 may be disposed in the sampling sub 225, while in other embodiments the gamma detector 215 may be disposed above (e.g. uphole of) the circulating valve 230.

In some embodiments, the circulating valve 230 may be disposed above (e.g. uphole of) the formation isolation valve 235. In some embodiments, the formation isolation valve 235 and/or circulating valve 230 may be disposed above (e.g. uphole of) the rotation-operated pump 205. In some embodiments, the sampling sub 225 may be disposed below (e.g. downhole of) the rotation-operated pump 205. In some embodiments, the packer isolation valve 220 may be disposed below (e.g. downhole of) the rotation-operated pump 205 and/or the sampling sub 225. In some embodiments, the packer isolation valve 220 may be disposed above (e.g. uphole of) the upper packer 132*a* (e.g. and in fluid communication with both the packers 132, for example being configured to divert fluid flow from the bore 126 to the packers 132 when in the open position). In some embodiments, the ported flow sub 210 may be disposed below (e.g. downhole of) the rotation-operated pump 205 and/or sampling sub 225 and/or packer isolation valve 220. In some embodiments, the ported flow sub 210 may be disposed between the upper packer 132*a* and the lower packer 132*b*. Some tool string 112 embodiments may further comprise a ported bull plug 275 disposed at the downhole end of the tool string 112 (e.g. downhole of the packers 132 and ported flow sub 210). Some tool string 112 embodiments may further comprise a gauge carrier 263 (e.g. configured to hold one or more gauge/sensor). In some embodiments, the gauge carrier 263 can be disposed below the ported flow sub 210 and/or lower packer and/or lower equalizing sub 240*b*. In some embodiments, the gauge carrier 263 can be disposed above the ported bull plug 275 (e.g. directly above). In some embodiments, the one or more gauge/sensor in the gauge carrier 263 may be configured to monitor pressure (e.g. bullhead pressure).

The tool string 112 embodiment of FIG. 2, or similar tool string embodiments configured for testing, may be used to implement one or more of the method embodiments set forth herein. While FIG. 2 illustrates an exemplary tool string 112 for well testing/sampling, alternate embodiments may include or remove one or more elements/subs. For example, the specific elements/subs and/or functionality included in the tool string 112 may depend on the features needed or desired for the specific method/process that the tool string 112 may be used to implement. So, persons of skill may consider the tool string 112 embodiments in the context of the related methods, and all such embodiments are included in the disclosure herein.

Improved methods for testing an exemplary well, for example for evaluation of whether the well should be produced (e.g. with hydrocarbons being extracted during production), are also disclosed herein. Some embodiments of the disclosed methods may significantly reduce carbon emissions (e.g. emissions based on formation fluids of the well), providing a greener approach to well testing. In some embodiments, the methods may use a tool string 112 similar to embodiments disclosed herein, for example as discussed with respect to FIG. 2.

By way of example, a method of (e.g. substantially carbon emission-free) testing a formation (e.g. reservoir) in an open hole well (e.g. to determine if the well is worth producing) may comprise: running a tool string 112 (e.g. workstring) downhole in the well; determining a location/depth for testing; setting (e.g. inflating) two packers 132 (e.g. based on the depth/location), thereby isolating a portion of the formation therebetween; placing the isolated portion of the formation (e.g. the portion between the packers 132) in fluid communication with a bore 126 of the tool string 112 (e.g. tubing); pumping formation fluids from the isolated portion of the formation uphole (e.g. towards the surface); evaluating the well (e.g. pumping/flow of the formation fluid) to determine whether a sample should be taken (e.g. using downhole sensors, for example capacitance sensor, optical sensors (e.g. ICE system), pressure, flowrate); responsive to determining that a sample should be taken, taking a sample of the formation fluid (e.g. using a sampling sub 225); and reinjecting formation fluids back into the formation (e.g. pumping the formation fluids in the tool string 112 downhole and back into the formation).

In some embodiments, determining a location/depth for testing may comprise using a gamma detector 215 in conjunction with a gamma radiation profile of the well (e.g. with a control system 168 comparing the gamma detection data to the gamma radiation profile of the well to determine depth/location). In some embodiments, setting the packers 132 comprises isolating a portion of the formation for testing/sampling and/or fixing the position of the tool string 112 within the well. In some embodiments, pumping formation fluids from the isolated portion of the formation uphole may include stopping pumping before the formation fluids reach the surface (e.g. only pumping mud out of the tool string 112 at the surface); in other embodiments, some formation fluids (e.g. a slug/sample) may be pumped out (e.g. at the surface), but may then be reinserted into the formation. In some embodiments, reinjecting formation fluids back into formation may comprise reinjecting all (or substantially all) formation fluids (e.g. pumped uphole and/or entering the bore 126 through the ported flow sub 210) back into formation. For example, all of the formation fluids pumped out of the formation can be reinjected into the formation. In some embodiments, the testing may be emission-free (e.g. free of hydrocarbon emissions) or substantially emission-free.

In some embodiments, pumping formation fluids may comprise rotating the tool string 112 to operate a pump, for example with the pump being a rotation-operated pump 205. As shown in FIG. 2, the rotation-operated pump 205 may be disposed in the tool string 112 downhole in the wellbore 108, and rotation of the tool string 112 may operate/power the pump. By way of example, rotating the tool string 112 may comprise using a rotary table or top drive to rotate the tool string 112. Some method embodiments may further comprise stopping pumping before the formation fluids reach the surface (e.g. only pumping mud out of the tool string 112 at the surface).

In some embodiments, determining a depth/location for testing may comprise detecting gamma radiation levels in the well and comparing the detected gamma radiation levels to a gamma radiation profile/map for the well. For example, the gamma radiation profile for the well may have previously been mapped, for example while drilling the well. In some embodiments, determining a depth/location may occur downhole, for example with a processor 260 disposed downhole evaluating the gamma data in comparison to the gamma profile. In other embodiments, determining the depth may occur at the surface, for example with a surface control system 168 receiving gamma radiation data from a gamma detector 215 for comparison to the gamma radiation profile (e.g. which may be stored in memory for the surface control system 168). Using gamma radiation to determine depth/location can allow depth/location of the tool string 112 (e.g. a ported flow sub 210 and/or sampling sub 225 of the tool string 112) to be determined more precisely within the well (e.g. with improved granularity). For example, the gamma detector 215 may be constantly recording as the string is being moved within the well, and the gamma detector 215 results can be compared to a previous wireline or drilling gamma sensor "map" or profile of the well to determine the exact location of the sensor and therefore the packer depths. Some embodiments may further comprise communicating detected gamma radiation levels uphole (e.g. to the surface for analysis) in real time. For example, detected gamma radiation levels may be communicated uphole via mud pulse (e.g. sending signals at sonic speed). For example, the gamma detector 215 may be configured to include a mud pulse communication system. Some method embodiments may further comprise developing a gamma radiation profile/map for the well (e.g. before insertion of tool string 112 for testing—e.g. when drilling well).

In some embodiments, setting the packers 132 may comprise inflating the packers 132. For example, mud or other fluid may be pumped from the surface (e.g. using a surface pump 124) to the packers 132 to inflate the packers 132. In some embodiments, this may comprise closing a circulating valve 230 (e.g. a telemetry or tubing pressure operated multiple cycle circulating valve 230, such as eMotion-HS by Halliburton), opening a packer isolation valve 220 (e.g. a telemetry, tubing pressure, or weight operated multiple cycle valve, such as eMotion-LV by Halliburton), which may place the packers 132 in fluid communication with the bore of the tool string 112, and pumping mud/fluid (e.g. from the bore) through the packer isolation valve 220 to inflate the packers 132 (after which the packer isolation valve 220 may be closed, to retain fluid in the packers 132). For example, the circulating valve ports configured to allow internal (e.g. bore) to external (e.g. annulus) communication could be closed. If the circulating valve also includes a string (e.g. bore) closure valve, it typically would be open to communicate the ID (e.g. bore) pressure down to inflate the packers. In embodiments, once the packers 132 have been inflated/set, they may retain the fluid therein (e.g. by closing the packer isolation valve 220) until it is time to unset the packers 132 (e.g. deflating the packers 132, for example by re-opening the packer isolation valve 220 to place the packers 132 into fluid communication with the bore 126, and allowing the fluid in the packers 132 to exit into the bore 126). While setting the packers 132 has been described herein specifically based on inflation of the packers 132 using the approach of FIG. 2, it should be understood that other mechanisms and procedures for setting the packers 132 may also be employed herein and are included within this disclosure.

Some embodiments may further comprise pressure equalizing above and below the two packers 132. For example, pressure equalizing (e.g. using two equalizing subs 240 disposed about the packers) may reduce loading of the packers 132. This pressure equalizing function typically may be static (e.g. not opened or closed), for example always open such that the pressure below the lower packer is always in communication with the pressure above the upper packer. In some embodiments, placing the isolated portion of the formation (e.g. the portion between the set/inflated packers) in fluid communication with the bore 126 of the tool string 112 may comprise opening a formation isolation valve 235 (e.g. eMotion-LV by Halliburton) to place the bore/tubing in fluid communication with the formation through a ported flow sub 210 disposed between the two set packers 132. For example, the formation isolation valve 235 may be in fluid communication with the ported flow sub 210, and may be configured to work in conjunction with the ported flow sub 210, for example to open and close the ported flow sub 210 (e.g. placing the ported flow sub 210 in fluid communication with the bore 126 and fluidly isolating the ported flow sub 210 from the bore 126 respectively).

Some embodiments may further comprise separating (e.g. keeping separate) formation fluid from tubing/mud fluid. For example, this may be done using a downhole wiper plug launching and catching system 250. For example, the wiper may be configured to act as a separator between formation fluid and mud in the bore 126. The plug catcher and launching system 250 may be configured to allow the wiper plug to progress upward/uphole in a portion of the bore 126 (e.g. above its location), but to prevent downward/downhole progress below its location. In embodiments, fluid in the bore 126 may progress upward beyond its location by moving the wiper plug upward, and fluid in the bore may progress downward beyond its location via bypass (e.g. even while the wiper plug is caught and blocks the main flowpath of fluid through the bore 126).

Embodiments may further comprise bleeding off surface pressure. For example, surface pressure may be bled off after isolating a portion of the formation but before placing in the isolated portion in fluid communication with the bore and/or pumping formation fluid. In some embodiments, after bleeding off pressure, pressure in the formation may be monitored for stabilization. Some embodiments may further comprise pressure testing the tool string 112 (e.g. with a pressure build test) prior to testing/evaluating.

In some embodiments, evaluating the well (e.g. the pumping/flow of the formation fluid) to determine whether a sample should be taken may comprise monitoring one or more parameters of the system 100 and evaluating the monitored/sensed parameters, for example to preliminarily determine if a sample should be taken. For example, this may entail monitoring rate of formation fluid movement uphole (e.g. during pumping), cumulative volume pumped, and/or torque required for pumping. In some embodiments, sensors may be used to evaluate/identify fluid, for example whether fluid is clean formation fluid or mud fluid. For example, when flow from the formation starts, it will be primarily mud, but as the pumping continues, the mud percentage will reduce and the formation fluid percentage will increase. At some point, the percentage typically stops changing so there is little reason to keep pumping to get a cleaner sample. Another limitation can be that once the tubing becomes full of pumped fluid, to avoid flaring, the sample can be taken even if the percentages are changing (e.g. not stabilized). The evaluation in some embodiments may comprise medium volume flow testing (e.g. with the volume being larger than wireline testing but less than drill stem testing that flows to the surface, is separated, and flared off). In some embodiments, placing the isolated portion into fluid communication may further comprise opening a formation isolation valve 235 in the tool string 112 (e.g. to place the formation in fluid communication with the pump), for example prior to pumping formation fluids uphole.

In some embodiments, taking a sample may comprise taking a sample downhole within the well (e.g. not at the surface). For example, a sampling sub 225 in the tool string 112 may be used to take the sample downhole in the well (e.g. not at the surface). In some embodiments, the sample may be held within the sampling sub 225 and then later removed from the well, for example when the tool string 112 is withdrawn from the well, for testing. In some embodiments, the sample may have a larger (e.g. a significantly larger) volume than is conventionally taken (e.g. compared to wireline sampling). For example, wireline sampler volumes can be limited due to the strength of the wire conveying the system downhole. With the disclosed sampling sub 225 embodiments being conveyed on pipe, many more samplers and/or larger samplers can be deployed. In some embodiments, the samplers may be approximately the conventional size, but many more could be run, for example with the samples being caught in multiple small sample chambers. In some embodiments, the sample may be sampled from a larger (e.g. a significantly larger) area. For example, the space/distance between the two packers 132 may range from approximately 1-10 meters, for example approximately 2 meters in some embodiments. In some embodiments, the sample chamber (e.g. of the sampling sub 225) may be larger (e.g. substantially larger) than conventionally used, for example extending approximately to the surface (e.g. a larger sample chamber configured so that the sample size could be roughly ½ a gallon of volume per foot of well depth). In some embodiments, the sample can be taken autonomously (e.g. with a processor 260 downhole identifying clean flow of formation fluid (e.g. based on one or more fluid property sensed and being relatively static) or after a preselected time of pumping). Some embodiments may further comprise sensing fluid in the tool string 112 (e.g. the bore and/or the sampling sub 225) to identify fluid (e.g. to determine if the sensed fluid is formation fluid or mud, for example to determine if a sample should be taken). In other embodiments, the sample may be taken in response to a surface signal (e.g. from the surface control system 168).

In some embodiments (for example in embodiments in which a sample is taken from formation fluids pumped uphole to the surface), the sample may be small and/or may be taken off-site for testing and/or disposal. For example, the sample may be a slug (e.g. with volume necessary to clean up the formation and get a good representative sample of the formation fluid). For example, in some embodiments, taking a sample may comprise pumping some (e.g. a small sample/slug of) formation fluids to the surface, and capturing a sample/slug of the formation fluids at the surface. By way of example, pumping the sample/slug to the surface may comprise pumping formation fluid (e.g. radially) through the circulating valve 230, into the annulus which extends around the tool string 112, and then uphole to the surface in the annulus. In embodiments, such pumping may be performed by the rotation-operated pump 205. In some embodiments, capturing the sample may prevent escape of liquids and gases into the external environment. Some embodiments may further comprise testing the sample on-site and reinjecting the captured formation fluids back into the formation. In embodiments, capturing at the surface and reinjecting formation fluids may prevent or minimize escape of any gases from the formation into the external environment (e.g. being carbon neutral, with substantially no carbon emissions). Other embodiments may comprise sending the sample of captured formation fluids off-site for more detailed testing/evaluation. In embodiments, the sample may be substantially undiluted formation fluid (e.g. with substantially no mud). In embodiments, the sample may not be separated on site (e.g. different liquids and/or gases within the sample are not separated out, but are captured as a mixture).

Some embodiments, may further comprise performing a formation shut-in test, stopping pumping (e.g. stop rotating the tool string 112), and waiting a specified time for shut-in. The shut-in test may include closing the formation isolation valve 235. In some embodiments, the pressure in the bore 126 may be monitored to make sure it falls off to formation pressure. If more flow periods are desired, testing may be repeated. Beneficially, reinjecting all formation fluids back into formation may prevent/eliminate burning/flaring of formation fluids during testing (e.g. preventing the need to dispose of formation fluids at the surface). Also, stopping pumping before the formation fluids reach the surface and reinjecting can prevent escape of any gases from the formation into the external environment (e.g. the atmosphere). Reinjecting all formation fluids can minimize environmental impact (e.g. with substantially no carbon emissions).

In embodiments, reinjecting may further comprise monitoring pressure required to bullhead and/or volume of fluid pumped back in (e.g. to determine when all formation fluids have been reinjected into the well). Once monitoring of the fluid flow downhole in the bore 126 indicates that all formation fluids have been reinjected (e.g. based on monitored volume, flowrate, and/or fluid testing (e.g. for type) indicating all formation fluids have been reinjected), pumping of fluids (e.g. for reinjection) may be stopped. In embodiments, pressures (e.g. of the formation) may be monitored after reinjection pumping has stopped.

In some embodiments, reinjecting formation fluid back into the formation may comprise pumping the formation fluids downhole in the bore 126 of the tool string 112, for example using a surface pump. For example, some embodiments may comprise opening a pump by-pass (e.g. for the rotation-operated pump 205), opening and/or keeping open the formation isolation valve 235 (e.g. to place the bore in fluid communication with the formation), and using the surface pump to pump the formation fluids back into the formation for reinjection. In other embodiments, reinjecting formation fluids into the formation may comprise reverse circulating fluids down the annulus. For example, this may entail opening the circulating valve 230 and pumping fluids from the bore radially outward to the annulus and down the annulus to reverse circulate (e.g. after which monitoring pressure required and volume pumped). In still other embodiments (e.g. when a sample is brought to the surface), fluid may be pumped down the annulus to the circulating valve 230, radially inward through the circulating valve 230 from the annulus 128 to the bore 126 of the tool string 112, through the pump bypass of the rotation-operated pump 205 and formation isolation valve 235, and into the formation.

After reinjection, method embodiments may comprise unsetting the packers 132. For example, this may entail closing the pump bypass, closing the formation isolation valve 235, and opening the packer isolation valve 220 of the tool string 112. After the packers 132 have been unset, the tool string 112 may be moved to the next zone/location for additional testing (e.g. using gamma radiation detection and the gamma profile once again to determine the location/depth). In embodiments, moving the tool string 112 may comprise opening the circulating valve 230, for example to allow moving to the next zone/location without having to move wet pipe (e.g. filled with fluid). In embodiments, moving the tool string 112 may comprises moving uphole in the wellbore. For example, testing/sampling may start at the bottom of the well (e.g. towards the toe 111) and move uphole to different zones/locations of interest. Testing may be performed at as many locations/zones in the well as desired (for example with potentially unlimited number of testing sites). Disclosed embodiments may beneficially release no (or minimal) hydrocarbons (e.g. from the well fluids) into the atmosphere (e.g. during testing). For example, since hydrocarbons are reinjected into the formation rather than flared on the surface, carbon emissions may be significantly minimized to provide a greener approach to well testing.

In some embodiments, the tool string 112/system 100 may not include a wireline. For example, the tool string 112 may be similar to embodiments discussed with respect to FIG. 2. Method embodiments may further comprise making up the tool string 112 (e.g. workstring), which may be configured for testing/sampling of the reservoir. Making up the tool string 112 may comprise fluidly coupling and/or physically attaching the elements/components/subs, for example to form a unitary tool string 112 having a bore 126. For example, the tool string 112 may comprise: a rotation-operated pump 205 configured to be driven by rotation of the tool string 112, a ported flow sub 210 (configured so that when open, it allows fluid communication between the formation and the bore 126 of the tool string 112), two or more packers 132 disposed about the ported sub (e.g. with an upper packer 132*a* disposed above the ported sub and a lower packer 132*b* disposed below the ported sub), and a gamma detector 215 (e.g. configured to detect gamma radiation (e.g. for location determination) and to transmit data regarding detected gamma radiation uphole (e.g. to the surface) via mud pulse). In some embodiments, it may be advantageous to use two (or more) upper packers and two (or more) lower packers. Typically, the formation would be tested between the two center packers, but the pressure in the area between the two upper and two lower packers may be monitored. Other embodiments may use other pumping techniques and/or other depth/location detection techniques, all of which are included herein.

The rotation-operated pump 205 may comprise a bypass configured to allow fluid pumped downhole from the surface (e.g. using a surface pump) to flow around the rotation-operated pump 205 downhole towards the ported flow sub 210. In embodiments, the bypass may comprise a bypass pathway and a check valve, for example with the check valve being configured to prevent passage (e.g. through the bypass pathway) of fluid flowing uphole, but to allow passage (e.g. through the bypass pathway) of fluid downhole. For example, the bypass pathway may fluidly connect a portion of the bore 126 below the rotation-operated pump 205 with a portion of the bore 126 above the rotation-operated pump 205, for example routing around the rotation-operated pump 205. The rotation-operated pump 205 may comprise a mud pump configured to be powered by rotation of the tool string 112. For example, in some embodiments the pump may comprise a progressive cavity pump or similar debris resistant pump, which may be configured to operate based on rotation of the tool string 112.

When making up the tool string 112, the tool string 112 may further comprise a packer isolation valve 220 having an open configuration and a closed configuration. For example, in the open configuration, the packer isolation valve 220 can allow setting/inflation of the packers 132, and in the closed configuration, the packer isolation valve 220 can retain fluid within the packers 132 (e.g. to maintain inflation). The packer isolation valve 220 can be configured to allow inflation of the packers 132 using fluid (e.g. mud) pumped downhole in the bore 126. The packer isolation valve 220 can also be configured to allow deflation of the packers 132 when opened (e.g. allowing fluid in the packers to exit into the bore 126).

In making up the tool string 112, the tool string 112 may further comprise a sampling sub 225, for example configured to take one or more sample of the formation fluid. In some embodiments, the sampling sub 225 may be configured to store the sample for extraction once the tool string 112 has been removed from the well, for example with the sample being later analyzed, for example offsite. In embodiments, the sampling sub 225 may also be configured to detect pressure (e.g. having one or more pressure sensor). When making up the tool string 112, the tool string 112 may further comprise a circulating valve 230 configured to control circulation/flow of fluids in the bore 126. For example, the circulating valve 230 may control circulation/flow of formation fluids uphole and/or control circulation/flow of formation fluids back downhole. In some embodiments, circulating valve 230 is configured to prevent fluid flow further uphole in the bore 126, but when opened allows fluid flow from the bore 126 (e.g. radially) to the annulus (e.g. for flow uphole in the annulus). In making up the tool string 112, the tool string 112 may further comprise a formation isolation valve 235, configured to open and close fluid communication between the formation and the bore 126 through the ported flow sub 210. In some embodiments, the tool string 112 may further comprise one or more equalizing sub 240 configured to reduce loading on the packers 132 (e.g. due to pressure imbalance). For example, two equalizing subs 240 could be included in the tool string 112, with an upper equalizing sub 240*a* located above the upper packer 132*a* and the lower equalizing sub 240*b* located below the lower packer 132*b* (and if running more packers, such as four packer elements, the equalizing typically would still just be between the very top and very bottom packer, for example with no equalizing between the two top or two bottom packers).

In making up the tool string 112, the tool string 112 may further comprise a plug catcher and launcher 250 configured to separate formation fluid from mud in the bore 126. For example, the plug catcher and launcher 250 may be disposed in the tool string 112 above the rotation-operated pump 205 and/or the formation isolation valve 235 (e.g. but below the circulating valve 230). In some embodiments, the plug catcher and launcher 250 may comprise a wiper plug and a bypass passage having a check valve (e.g. configured to allow passage of fluid therethrough only downhole). The wiper plug may be configured to move uphole when fluid is pumped uphole in the bore 126, but can be caught and prevented from moving downhole beyond the plug catcher and launcher 250 when fluid is pumped downhole (e.g. and though the bypass passage). In embodiments, the various elements/subs may be fluidly coupled, for example in the order described with respect to FIG. 2. For example, making up the tool string 112 may comprise coupling the various elements/subs together (e.g. end to end) to form the tool string 112 with the longitudinal bore 126. In some embodiments, the tool string 112 may have an approximately constant bore/pipe size (e.g. at least from the plug catcher and launcher 250 to the circulating valve 230, or to the surface). In some embodiments, the tool string 112 may further comprise a processor 260 configured to evaluate detected/sensed data to determine clean flow of formation fluid (e.g. based on one or more sensor configured to identify the fluid or based on preselected time to initiate testing/evaluation/sampling). For example, the sampling sub 225 may house the processor 260 in some embodiments. In embodiments, the open hole of the wellbore may have a diameter of approximately 7.88 inches or 13.5 inches, and the tool string 112 may have a maximum outer diameter of approximately 7 inches or 9 inches respectively.

Once the tool string 112 has been made up (for example in the manner described above and/or shown in FIG. 2), it may be inserted downhole in the well for testing and/or sampling, for example starting towards the bottom of the well and moving upward.

ADDITIONAL DISCLOSURE

The following are non-limiting, specific embodiments in accordance with the present disclosure:

In a first embodiment, a method of (e.g. substantially emission-free) testing a formation (e.g. a hydrocarbon reservoir) in an open hole well (e.g. to determine if the well is worth producing) comprises: running a tool string/workstring downhole in the well (e.g. inserting a tool string into the well); determining a location/depth for testing (e.g. using a gamma detector in conjunction with a gamma radiation profile of the well); setting (e.g. inflating) two packers, thereby isolating a portion of the formation therebetween (e.g. to isolate a portion of the formation for testing/sampling and/or to fix the position of the tool string within the well); placing the isolated portion of the formation (e.g. portion between the packers) in fluid communication with a bore of the tool string (e.g. tubing); pumping formation fluids from the isolated portion of the formation uphole (e.g. towards the surface) (e.g. pumping formation fluids up through the bore of the tool string); evaluating (e.g. pumping/flow of the formation fluid and/or the well) to determine whether a sample should be taken (e.g. using downhole sensors, for example capacitance sensor, optical sensors (e.g. ICE system), pressure, flowrate); responsive to determining that a sample should be taken, taking a sample of the formation fluid (e.g. using a sampling sub); and reinjecting formation fluids back into formation (e.g. pumping the formation fluids in the tool string downhole and back into the formation).

A second embodiment can include the method of the first embodiment, wherein reinjecting formation fluids back into formation comprises reinjecting all formation fluids (e.g. all formation fluids pumped uphole and/or entering the bore through a ported flow sub) back into formation (e.g. all of the formation fluids pumped out of the formation are reinjected into the formation).

A third embodiment can include the method of the first or second embodiment, wherein the testing is (e.g. substantially) hydrocarbon emission-free (e.g. there are no emissions of hydrocarbons from the well formation fluids).

A fourth embodiment can include the method of any one of the first to third embodiments, wherein pumping formation fluids comprises rotating the workstring to operate a pump, wherein the pump is a rotation-operated pump.

A fifth embodiment can include the method of any one of the first to fourth embodiments, wherein rotating the workstring comprises using a rotary table or top drive to rotate the tool string.

A sixth embodiment can include the method of any one of the first to fifth embodiments, further comprising stopping pumping before the formation fluids reach the surface (e.g. only pump mud out of the tool string at the surface).

A seventh embodiment can include the method of any one of the first to sixth embodiments, wherein determining a depth/location for testing comprises detecting gamma radiation levels in the well and comparing the detected gamma radiation levels to a gamma radiation profile for the well (e.g. previously mapped, for example while drilling the well) (e.g. in some embodiments may occur downhole—e.g. with processor disposed downhole).

An eighth embodiment can include the method of any one of the first to seventh embodiments, wherein depth/location can be determined more precisely than conventionally (e.g. with improved granularity).

A ninth embodiment can include the method of any one of the seventh to eighth embodiments, further comprising communicating detected gamma radiation levels uphole (e.g. to surface for analysis) in real time, e.g. via mud pulse (e.g. sending signals at sonic speed).

A tenth embodiment can include the method of any one of the seventh to ninth embodiments, further comprising developing a gamma radiation profile/map for the well (e.g. before insertion of tool string for testing—e.g. when drilling well).

An eleventh embodiment can include the method of any one of the first to tenth embodiments, wherein setting the packers comprises inflating the packers—e.g. pumping mud from the surface (e.g. using a surface pump) to the packers—e.g. by closing a circulating valve (e.g. a telemetry or tubing pressure operated multiple cycle circulating valve, such as eMotion-HS), opening a packer isolation valve (e.g. a telemetry, tubing pressure, or weight operated multiple cycle valve, such as eMotion-LV), and pumping mud/fluid through the packer isolation valve to inflate packers—then closing the packer isolation valve to retain the fluid in the inflated packers.

A twelfth embodiment can include the method of any one of the first to eleventh embodiments, wherein setting the packers comprises alternate mechanisms for inflation (e.g. flowing fluid through a separate tube or pathway other than the bore) or other packer setting mechanisms (e.g. using mechanical or chemical setting)(for example, based on the particular type of packer being used).

A thirteenth embodiment can include the method of any one of the first to twelfth embodiments, further comprising pressure equalizing above and below the two packers (e.g. to reduce loading of the packers).

A fourteenth embodiment can include the method of any one of the first to thirteenth embodiments, wherein (e.g. after isolating the portion of the formation) placing the isolated portion of the formation (e.g. portion between the packers) in fluid communication with a bore of the tool string comprises opening a formation isolation valve (e.g. eMotion-LV) to place the bore/tubing in fluid communication with the formation through a ported flow sub disposed between the two set packers.

A fifteenth embodiment can include the method of any one of the first to fourteenth embodiments, further comprising separating (e.g. keeping separate) formation fluid from tubing/mud fluid (e.g. using a downhole wiper plug launching and catching system).

A sixteenth embodiment can include the method of any one of the first to fifteenth embodiments, further comprising bleeding off surface pressure (e.g. after isolating but before placing in fluid communication and/or pumping formation fluid) and monitoring pressure in the formation for stabilization.

A seventeenth embodiment can include the method of any one of the first to sixteenth embodiments, further comprising pressure testing the tool string (e.g. using a pressure build test) prior to testing/evaluating.

An eighteenth embodiment can include the method of any one of the first to seventeenth embodiments, wherein evaluating the well (e.g. the pumping/flow of the formation fluid) to determine whether a sample should be taken comprises monitoring rate of formation fluid movement uphole, cumulative volume pumped, and/or torque required for pumping (e.g. and in some embodiments, evaluating data from sensors to identify fluid, for example whether fluid is clean formation fluid or includes mud fluid).

A nineteenth embodiment can include the method of any one of the first to eighteenth embodiments, wherein evaluating comprises medium volume flow testing.

A twentieth embodiment can include the method of any one of the first to nineteenth embodiments, further comprising opening a formation isolation valve in the tool string (e.g. to place formation in fluid communication with the pump) prior to pumping formation fluids uphole.

A twenty-first embodiment can include the method of any one of the first to twentieth embodiments, wherein taking a sample comprises taking a sample downhole within the well (e.g. not at the surface), for example using a sampling sub to take the sample downhole in the well (e.g. not at the surface) (e.g. wherein the sample may be removed from the well when the tool is withdrawn from the well, for testing).

A twenty-second embodiment can include the method of any one of the first to twenty-first embodiments, wherein the sample has a larger volume (e.g. than conventional wireline sampling) and/or samples from a larger area (e.g. the space between the two packers, which may range from approximately 1-10 m, for example approximately 2 m).

A twenty-third embodiment can include the method of any one of the first to twenty-second embodiments, wherein a sample chamber extends approximately to the surface for collection of the sample (e.g. the sampling sub can include a significantly larger sample chamber than conventional—e.g. approximately ½ gallon per foot of well depth).

A twenty-fourth embodiment can include the method of any one of the first to twenty-third embodiments, wherein the sample is taken autonomously (e.g. with a processor downhole identifying clean flow of formation fluid (e.g. based on one or more fluid property sensed and such sensed property holding static) or after a preselected time of pumping (which has been determined to result in clean fluid at the sampling site, and which may in some embodiments be based on the pumping rate).

A twenty-fifth embodiment can include the method of any one of the first to twenty-fourth embodiments, further comprising sensing fluid in tool string to identify fluid (e.g. to determine if fluid is formation fluid or mud).

A twenty-sixth embodiment can include the method of any one of the first to twenty-fifth embodiments, wherein the sample is taken in response to a surface signal (e.g. from a surface control system).

A twenty-seventh embodiment can include the method of any one of the first to twenty-sixth embodiments, wherein the sample is small (e.g. a slug) and/or is taken off-site for testing and/or disposal.

A twenty-eighth embodiment can include the method of any one of the first to twenty-seventh embodiments, wherein taking a sample comprises pumping some (e.g. a small sample/slug of) formation fluids to the surface, and capturing a sample/slug of the formation fluids at the surface.

A twenty-ninth embodiment can include the method of the twenty-eighth embodiment, wherein pumping the sample/slug to the surface comprises pumping formation fluid (e.g. radially) through the circulating valve, into the annulus around the tool string, and then uphole to the surface in the annulus.

A thirtieth embodiment can include the method of any one of the twenty-eighth to twenty-ninth embodiments, wherein capturing the sample prevents escape of liquids and gases into the external environment.

A thirty-first embodiment can include the method of any one of the twenty-eighth to thirtieth embodiments, further comprising testing the sample on-site and reinjecting the captured formation fluids back into the formation.

A thirty-second embodiment can include the method of any one of the twenty-eighth to thirty-first embodiments, further comprising sending the sample of captured formation fluids off-site for more detailed testing/evaluation.

A thirty-third embodiment can include the method of any one of the first to thirty-second embodiments, wherein the sample is substantially undiluted formation fluid (e.g. substantially no mud).

A thirty-fourth embodiment can include the method of any one of the first to thirty-third embodiments, wherein the sample is not separated on site (e.g. different liquids and/or gases within the sample are not separated out, but are captured as a mixture).

A thirty-fifth embodiment can include the method of any one of the first to thirty-fourth embodiments, further comprising performing a formation shut-in test (e.g. closing the formation isolation valve, stopping pumping (e.g. stop rotating the tool string), and waiting a specified time for shut-in (e.g. monitoring pressure in the bore to make sure it falls off to formation pressure).

A thirty-sixth embodiment can include the method of any one of the first to thirty-fifth embodiments, wherein if more flow periods are desired, repeat testing.

A thirty-seventh embodiment can include the method of any one of the first to thirty-sixth embodiments, wherein reinjecting all formation fluids back into formation prevents/eliminates burning/flaring (e.g. with a flare) of formation fluids during testing (e.g. prevents need to dispose of formation fluids at the surface and/or the associated carbon emission release).

A thirty-eighth embodiment can include the method of any one of the sixth to thirty-seventh embodiments, wherein stopping pumping before the formation fluids reach the surface and reinjecting prevents escape of any gases from the formation into the external environment (e.g. the atmosphere).

A thirty-ninth embodiment can include the method of any one of the twenty-eighth to thirty-seventh embodiments, wherein capturing at the surface and reinjecting formation fluids prevents escape of any gases from the formation into the external environment (e.g. carbon neutral—substantially no carbon emissions).

A fortieth embodiment can include the method of any one of the first to thirty-ninth embodiments, wherein reinjecting all formation fluids minimizes environmental impact (e.g. substantially no carbon emissions).

A forty-first embodiment can include the method of any one of the first to fortieth embodiments, wherein reinjecting formation fluids comprises opening a pump by-pass (e.g. for the rotation-operated pump), opening a formation isolation valve, and using a surface pump to pump the formation fluids back into the formation.

A forty-second embodiment can include the method of any one of the first to forty-first embodiments, further comprising monitoring pressure required to bullhead and/or volume of fluid pumped back in.

A forty-third embodiment can include the method of any one of the first to forty-second embodiments, further comprising, responsive to monitoring of the fluid flow downhole in the bore indicting that all formation fluids have been reinjected (e.g. monitored volume, flowrate, and/or fluid testing (e.g. for type) indicating all formation fluids have been reinjected), stopping pumping.

A forty-fourth embodiment can include the method of the forty-third embodiment, further comprising, after stopping reinjection pumping, monitoring pressures (e.g. of the formation).

A forty-fifth embodiment can include the method of any one of the first to fortieth embodiments, wherein reinjecting formation fluids comprises reverse circulating down the annulus (e.g. opening the circulating valve and pumping fluid down the annulus to reverse circulate—in some embodiments, reverse circulating pumping may be performed using the downhole rotary-operated pump and/or monitoring pressure required and volume pumped uphole to estimate when to expect sample recirculation).

A forty-sixth embodiment can include the method of any one of the first to fortieth embodiments, wherein reinjecting formation fluids comprises (e.g. when circulating valve is open) reverse circulating formation fluid down the annulus to the circulating valve (e.g. into the bore through the circulating valve, and then closing the circulating valve), through the pump bypass and formation isolation valve, and into the formation (e.g. with reverse circulating and/or pumping fluid through the pump bypass and formation isolation valve being performed by the downhole rotary-operated pump in some embodiments).

A forty-seventh embodiment can include the method of any one of the first to forty-sixth embodiments, further comprising unsetting the packers (e.g. close the pump bypass, close the formation isolation valve, open the packer isolation valve, and deflate the packers).

A forty-eighth embodiment can include the method of any one of the first to forty-seventh embodiments, further comprising moving the tool string to the next zone/location for additional testing (e.g. using gamma radiation detection and gamma profile to determine the next zone), wherein: moving the tool string may comprise opening the circulation valve to allow moving to the next zone/location without having to move wet pipe (e.g. filled with fluid) and/or moving the tool string may comprise moving uphole (e.g. with testing starting at the bottom of the well and moving uphole to different zones/locations).

A forty-ninth embodiment can include the method of any one of the first to forty-eighth embodiments, further comprising performing testing at as many locations/zones in the well as desired (potentially unlimited number of testing sites).

A fiftieth embodiment can include the method of any one of the first to forty-ninth embodiments, further comprising releasing no hydrocarbons from the well into the atmosphere (e.g. during testing).

A fifty-first embodiment can include the method of any one of the first to fiftieth embodiments, wherein the tool string/system does not include a wireline.

A fifty-second embodiment can include the method of any one of the first to fifty-first embodiments, further comprising making up the tool string/workstring, wherein the tool string comprises: a rotation-operated pump configured to be driven by rotation of the tool string, a ported flow sub (e.g. configured so that when open, it allows fluid communication between the formation and the bore of the tool string), two packers disposed about the ported flow sub (e.g. with an upper packer disposed above the ported flow sub and a lower packer disposed below the ported sub), and a gamma detector (e.g. configured to detect gamma radiation (e.g. for location determination) and to transmit data regarding detected gamma radiation uphole (e.g. to the surface) via mud pulse)).

A fifty-third embodiment can include the method of the fifty-second embodiment, wherein the rotation-operated pump comprises a bypass configured to allow fluid pumped downhole from the surface (e.g. using a surface pump) to flow around the rotation-operated pump downhole towards the ported flow sub).

A fifty-fourth embodiment can include the method of the fifty-third embodiment, wherein the bypass comprises a bypass pathway and a check valve, wherein the check valve is configured to prevent passage (e.g. through the bypass pathway) of fluid flowing uphole but to allow passage (e.g. through the bypass pathway) of fluid downhole.

A fifty-fifth embodiment can include the method of any one of the fifty-second to fifty-fourth embodiments, wherein the rotation-operated pump comprises a mud pump configured to be powered by rotation of the tool string (e.g. in some embodiments, the pump may comprise a progressive cavity pump or similar debris resistant pump).

A fifty-sixth embodiment can include the method of any one of the fifty-second to fifty-fifth embodiments, wherein the tool string further comprises a packer isolation valve having an open configuration and a closed configuration, wherein in the open configuration, the packer isolation valve allows setting/inflation of the packers, and in the closed configuration, the packer isolation valve retains fluid within the packers (e.g. to maintain inflation).

A fifty-seventh embodiment can include the method of the fifty-sixth embodiment, wherein the packer isolation valve is configured to allow inflation of the packers using fluid (e.g. mud) pumped downhole in the bore.

A fifty-eighth embodiment can include the method of any one of the fifty-second to fifty-seventh embodiments, wherein the tool string further comprises a sampling sub (configured to take one or more sample of the formation fluid (for example, to store the sample for extraction once the tool string has been removed from the well, with the sample being later analyzed, for example offsite)).

A fifty-ninth embodiment can include the method of the fifty-eighth embodiment, wherein the sampling sub is further configured to detect pressure (e.g. comprises one or more pressure sensor).

A sixtieth embodiment can include the method of any one of the fifty-second to fifty-ninth embodiments, wherein the tool string further comprises a circulating valve configured to control circulation/flow of fluids in the bore (e.g. control circulation/flow of formation fluids uphole and/or control circulation/flow of formation fluids back downhole).

A sixty-first embodiment can include the method of the sixtieth embodiment, wherein the circulating valve is configured to prevent fluid flow further uphole in the bore, but when opened allows fluid flow from the bore (e.g. radially) to the annulus (e.g. for flow uphole in the annulus) (e.g. and when closed, prevents such fluid flow radially).

A sixty-second embodiment can include the method of any one of the fifty-second to sixty-first embodiments, wherein the tool string further comprises a formation isolation valve, configured to open and close fluid communication between the formation and the bore through the ported flow sub.

A sixty-third embodiment can include the method of any one of the fifty-second to sixty-second embodiments, wherein the tool string further comprises one or more equalizing sub configured to reduce loading on the packers (e.g. due to pressure imbalance) and/or a plug catcher and launcher (e.g. disposed above the rotation-operated pump and/or the formation isolation valve (e.g. but below the circulating valve) configured to separate formation fluid from mud (e.g. comprises a wiper plug and a bypass passage having a check valve (configured to allow passage of fluid therethrough only downhole), wherein the wiper plug is configured to move uphole when fluid is pumped uphole, but is caught and prevented from moving downhole beyond the plug catcher and launcher when fluid is pumped downhole (e.g. and though the bypass passage)).

A sixty-fourth embodiment can include the method of any one of the first to sixty-third embodiments, wherein the tool string further comprises a processor/control system configured to evaluate detected/sensed data to determine clean flow of formation fluid (e.g. based on one or more sensor configured to identify the fluid or based on preselected time to initiate testing/evaluation/sampling).

In a sixty-fifth embodiment, a tool string for testing a hydrocarbon well formation comprises: a rotation-operated pump configured to be driven by rotation of the tool string (e.g. using a rotary table and/or top drive); a ported flow sub (configured so that when open, it allows fluid communication between the formation and the bore of the tool string); two packers disposed about the ported sub (e.g. with an upper packer disposed above the ported sub and a lower packer disposed below the ported sub); and a gamma detector (e.g. configured to detect gamma radiation (e.g. for location determination) and to transmit data regarding detected gamma radiation uphole (e.g. to the surface) via mud pulse)).

A sixty-sixth embodiment can include the tool string of the sixty-fifth embodiment, wherein the rotation-operated pump comprises a bypass configured to allow fluid pumped downhole from the surface (e.g. using a surface pump) to flow around the rotation-operated pump downhole towards the ported flow sub).

A sixty-seventh embodiment can include the tool string of the sixty-sixth embodiment, wherein the bypass comprises a bypass pathway and a check valve, wherein the check valve is configured to prevent passage (e.g. through the bypass pathway) of fluid flowing uphole but to allow passage (e.g. through the bypass pathway) of fluid downhole.

A sixty-eighth embodiment can include the tool string of any one of the sixty-fifth to sixty-seventh embodiments, wherein the rotation-operated pump comprises a mud pump configured to be powered by rotation of the tool string (in some embodiments, the pump may comprise a progressive cavity pump or similar debris resistant pump).

A sixty-ninth embodiment can include the tool string of any one of the sixty-fifth to sixty-eighth embodiments, further comprising a packer isolation valve having an open configuration and a closed configuration, wherein in the open configuration, the packer isolation valve allows setting/inflation of the packers, and in the closed configuration, the packer isolation valve retains fluid within the packers (e.g. to maintain inflation).

A seventieth embodiment can include the tool string of the sixty-ninth embodiment, wherein the packer isolation valve is configured to allow inflation of the packers using fluid (e.g. mud) pumped downhole in a bore of the tool string.

A seventy-first embodiment can include the tool string of any one of the sixty-fifth to seventieth embodiments, further comprising a sampling sub (configured to take a sample of the formation fluid (for example, to store the sample for extraction once the tool string has been removed from the well, with the sample being later analyzed, for example offsite)).

A seventy-second embodiment can include the tool string of the seventy-first embodiment, wherein the sampling sub is further configured to detect pressure (e.g. comprises one or more pressure sensor).

A seventy-third embodiment can include the tool string of any one of the seventy-first to seventy-second embodiments, wherein the sampling sub comprises a sample chamber extending approximately to the surface (e.g. a larger sample chamber).

A seventy-fourth embodiment can include the tool string of any one of the seventy-first to seventy-third embodiments, wherein the sample is taken autonomously by the sampling sub (e.g. with a processor downhole identifying clean flow of formation fluid (e.g. fluid property sensed and static) or after a preselected time of pumping).

A seventy-fifth embodiment can include the tool string of any one of the sixty-fifth to seventy-fourth embodiments, further comprising a circulating valve configured to control circulation/flow of fluids in the bore (e.g. control circulation/flow of formation fluids uphole and/or control circulation/flow of formation fluids back downhole) (e.g. control flow of fluids in the bore (e.g. preventing flow upward beyond the circulating valve in the bore) and/or allow (e.g. when open) flow radially between the bore and the annulus around the tool string (e.g. to allow flow uphole beyond the circulating valve in the annulus).

A seventy-sixth embodiment can include the tool string of any one of the sixty-fifth to seventy-fifth embodiments, further comprising a formation isolation valve, configured to open and close fluid communication between the formation and the bore through the ported sub.

A seventy-seventh embodiment can include the tool string of any one of the sixty-fifth to seventy-sixth embodiments, further comprising one or more equalizing sub configured to reduce loading on the packers (e.g. due to pressure imbalance) (e.g. typically two equalizing subs, with a first equalizing sub located above the upper packer and a second equalizing sub located below the lower packer).

A seventy-eighth embodiment can include the tool string of any one of the sixty-fifth to seventy-seventh embodiments, further comprising a plug catcher and launcher (e.g. disposed above the rotation-operated pump and/or the formation isolation valve (e.g. but below the circulating valve)) configured to separate formation fluid from mud (e.g. comprises a wiper plug and a bypass passage having a check valve (configured to allow passage of fluid therethrough only downhole), wherein the wiper plug is configured to move uphole when fluid is pumped uphole, but is caught and prevented from moving downhole beyond the plug catcher and launcher when fluid is pumped downhole (e.g. and though the bypass passage).

A seventy-ninth embodiment can include the tool string of any one of the sixty-fifth to seventy-eight embodiments, wherein the tool string has a constant bore/pipe size (e.g. at least from the plug catcher and launcher to the circulating valve, or to the surface) (e.g. the bore may extending substantially the length of the tool string and/or may extend along the longitudinal centerline of the tool string).

An eightieth embodiment can include the tool string of any one of the sixty-fifth to seventy-ninth embodiments, further comprising a processor/control system configured to evaluate detected/sensed data to determine clean flow of formation fluid (e.g. based on one or more sensor configured to identify the fluid or based on preselected time to initiate testing/evaluation/sampling) (e.g. disposed in the tool string).

An eighty-first embodiment can include the tool string of the eightieth embodiment, wherein the processor may be disposed in the sampling sub (or any other element/sub of the tool string).

An eighty-second embodiment can include the tool string of any one of the eightieth to eighty-first embodiments, wherein the one or more sensor may comprise one or more sensor configured to detect/sense fluid type, pressure, and/or temperature at one or more location of the tool string.

An eighty-third embodiment can include the tool string of any one of the sixty-fifth to eighty-second embodiments, wherein the gamma detector may be disposed in the sampling sub.

An eighty-fourth embodiment can include the tool string of any one of the sixty-fifth to eighty-first embodiments, wherein the gamma detector may be disposed above (e.g. uphole of) the circulating valve.

An eighty-fifth embodiment can include the tool string of any one of the sixty-fifth to eighty-fourth embodiments, wherein the circulating valve may be disposed above (e.g. uphole of) the formation isolation valve.

An eighty-sixth embodiment can include the tool string of any one of the sixty-fifth to eighty-fifth embodiments, wherein the formation isolation valve and/or circulating valve may be disposed above (e.g. uphole of) the rotation-operated pump.

An eighty-seventh embodiment can include the tool string of any one of the sixty-fifth to eighty-sixth embodiments, wherein the sampling sub may be disposed below (e.g. downhole of) the rotation-operated pump.

An eighty-eighth embodiment can include the tool string of any one of the sixty-fifth to eighty-seventh embodiments, wherein the packer isolation valve may be disposed below (e.g. downhole of) the rotation-operated pump and/or the sampling sub.

An eighty-ninth embodiment can include the tool string of any one of the sixty-fifth to eighty-eighth embodiments, wherein the packer isolation valve may be disposed above (e.g. uphole of) the upper packer (and in fluid communication with both the packers—e.g. configured to divert flow from the bore to the packers).

A ninetieth embodiment can include the tool string of any one of the sixty-fifth to eighty-ninth embodiments, wherein the ported flow sub is disposed below (e.g. downhole of) the rotation-operated pump and/or sampling sub and/or packer isolation valve.

A ninety-first embodiment can include the tool string of any one of the sixty-fifth to ninetieth embodiments, further comprising a ported bull plug disposed at the downhole end of the tool string (e.g. downhole of the packers and ported flow sub).

A ninety-second embodiment can include the tool string of any one of the sixty-fifth to ninety-first embodiments, further comprising a gauge carrier (e.g. configured to hold one or more gauge/sensor).

A ninety-third embodiment can include the tool string of the ninety-second embodiment, wherein the gauge carrier is disposed below the ported flow sub and/or lower packer and/or lower equalizing sub, and/or wherein the gauge carrier is disposed above the ported bull plug.

A ninety-fourth embodiment can include the tool string of any one of the ninety-second to ninety-third embodiments, wherein the one or more gauge is configured to monitor pressure (e.g. bullhead pressure).

In a ninety-fifth embodiment, a system for testing a hydrocarbon reservoir/formation comprises: a well having a wellbore extending into the formation; and a tool string disposed within the wellbore, wherein the tool string comprises the tool string of any one of the sixty-fifth to ninety-fourth embodiments.

A ninety-sixth embodiment can include the system of the ninety-fifth embodiment, further comprising a conveyance mechanism configured to position the tool string within the wellbore (e.g. at a selected depth) and/or to move the tool string up or down in the wellbore.

A ninety-seventh embodiment can include the system of any one of the ninety-fifth to ninety-sixth embodiments, further comprising a surface pump configured to pump mud/fluid into and out of the bore of the tool string.

A ninety-eighth embodiment can include the system of any one of the ninety-fifth to ninety-seventh embodiments, further comprising a surface control system, which may be configured to receive data from the gamma detector, to compare the data to a gamma radiation map/profile to determine depth, and to control the conveyance mechanism (e.g. winch) to precisely position the tool string within the wellbore (e.g. at a selected depth).

A ninety-ninth embodiment can include the system of the ninety-eighth embodiment, wherein the control system is configured to receive the data from the gamma detector via mud pulse.

A one hundredth embodiment can include the system of any one of the ninety-fifth to ninety-ninth embodiments, further comprising a rotary table and/or top drive configured to rotate the tool string (e.g. rotating the top of the tool string to rotate the entire tool string).

A one hundred first embodiment can include the system of the one hundredth embodiment, wherein the control system operates the rotary table and/or top drive in order to operate the rotary-operated pump in the tool string.

A one hundred second embodiment can include the method of any one of the first to sixty-fourth embodiments, wherein the tool string comprises any one of the sixty-fifth to ninety-fourth system embodiments.

A one hundred third embodiment can include the system of any one of the ninety-fifth to one hundred first embodiments, configured to carry out the method of any one of the first to sixty-fourth embodiments.

In a one hundred fourth embodiment, a programmable storage device having program instructions stored thereon for causing a processor to perform the method according to any one of the first to sixty-fourth embodiments.

In a one hundred fifth embodiment, a non-transitory computer-readable medium having program instructions stored thereon for causing a control system/processor to perform the method of any one of the first to sixty-fourth embodiments.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

The invention claimed is:

1. A method of testing a formation in an open hole well, comprising:

running a tool string downhole in the well;

determining a depth for testing;

setting two packers, thereby isolating a portion of the formation therebetween;

placing the isolated portion of the formation in fluid communication with a bore of the tool string;

pumping formation fluids from the isolated portion of the formation uphole, wherein pumping formation fluids comprises rotating the tool string to operate a rotation-operated pump disposed downhole in the tool string;

evaluating the well to determine whether a sample should be taken;

responsive to determining that a sample should be taken, taking a sample of the formation fluid; and reinjecting the formation fluids back into the formation; wherein reinjecting formation fluids comprises opening a pump by-pass for the rotation-operated pump, opening a formation isolation valve to place the bore of the tool string in fluid communication with the formation through a ported flow sub disposed in the tool string between the two set packers, and using a surface pump to pump the formation fluids back into the formation.

2. The method of claim 1, further comprising stopping pumping of formation fluids before the formation fluids reach surface, and wherein reinjecting formation fluids back into the formation comprises reinjecting all formation fluids pumped uphole back into the formation.

3. The method of claim 1, wherein rotating the tool string comprises using a rotary table or top drive at the surface to rotate the tool string.

4. The method of claim 1, wherein determining a depth for testing comprises detecting gamma radiation levels in the well and comparing the detected gamma radiation levels to a gamma radiation profile for the well.

5. The method of claim 4, further comprising developing the gamma radiation profile for the well, and communicating detected gamma radiation levels uphole via mud pulse.

6. The method of claim 1, wherein setting the packers comprises closing a circulating valve disposed in the tool string, opening a packer isolation valve disposed in the tool string, and pumping fluid through the packer isolation valve to inflate the packers.

7. The method of claim 1, wherein placing the isolated portion of the formation in fluid communication with a bore of the tool string comprises opening a formation isolation valve to place the bore in fluid communication with the formation through a ported flow sub disposed in the tool string between the two set packers.

8. The method of claim 1, wherein taking a sample comprises taking a sample of formation fluid downhole within the well.

9. The method of claim 1, further comprising making up the tool string, wherein the tool string comprises: a rotation-operated pump configured to be driven by rotation of the tool string; a ported flow sub configured so that when open, it allows fluid communication between the formation and the bore of the tool string; two packers, with an upper packer disposed above the ported flow sub and a lower packer disposed below the ported flow sub; and a gamma detector configured to detect gamma radiation for depth determination in the wellbore and to transmit data regarding detected gamma radiation uphole to a surface control system.

10. The method of claim 1, further comprising stopping pumping of formation fluids before the formation fluids reach surface, wherein taking a sample comprises taking a sample downhole within the well.

11. The method of claim 1, wherein taking a sample comprises pumping a sample slug of formation fluids to surface, and capturing the sample slug at the surface, and wherein capturing the sample slug prevents escape of liquids and gases into an external environment.

12. The method of claim 11, wherein pumping the sample slug to the surface comprises pumping formation fluid through a circulating valve disposed above the rotation-operated pump, into an annulus around the tool string, and then uphole in the annulus to the surface.

13. A tool string for testing a hydrocarbon well formation, comprising:

a rotation-operated pump configured to be driven by rotation of the tool string; wherein the rotation-operated pump comprises a bypass configured to allow fluid pumped downhole to flow around the rotation-operated pump;

a ported flow sub configured so that when open, it allows fluid communication between the formation and a bore of the tool string;

two packers disposed about the ported flow sub, with an upper packer disposed above the ported flow sub and a lower packer disposed below the ported flow sub; and a gamma detector configured to detect gamma radiation and to transmit data regarding detected gamma radiation uphole.

14. The tool string of claim 13, further comprising a sampling sub configured to take one or more sample of formation fluid from downhole in the well, wherein the sampling sub is disposed below the rotation-operated pump, and wherein the ported flow sub is disposed below the sampling sub.

15. The tool string of claim 13, further comprising a circulating valve configured to prevent fluid flow uphole beyond the circulating valve in the bore of the tool string and, when open, to allow flow radially between the bore and an annulus around the tool string.

16. The tool string of claim 15, further comprising a formation isolation valve configured to open and close fluid communication between the formation and the bore through the ported flow sub, wherein the circulating valve is disposed above the formation isolation valve and the rotation-operated pump.

17. A system for testing a hydrocarbon formation penetrated by a wellbore, comprising:

a tool string disposed within the wellbore, wherein the tool string comprises:

a rotation-operated pump configured to be driven by rotation of the tool string, wherein the rotation-operated pump comprises a bypass;

a ported flow sub configured so that when open, it allows fluid communication between the formation and a bore of the tool string;

two packers disposed about the ported flow sub, with an upper packer disposed above the ported flow sub and a lower packer disposed below the ported flow sub; and a gamma detector configured to detect gamma radiation and to transmit data regarding detected gamma radiation uphole; and a surface pump configured to pump fluid into or out of the bore of the tool string.

18. The system of claim 17, further comprising a conveyance mechanism configured to position the tool string within the wellbore at a selected depth and to alter depth of the tool string within the wellbore.

19. The system of claim 18, further comprising a surface control system configured to receive the data from the gamma detector, to compare the data to a gamma radiation profile to determine depth, and to control the conveyance mechanism to precisely position the tool string within the wellbore.

20. The system of claim 17, further comprising a rotary table and/or top drive configured to rotate the tool string, thereby driving the rotation-operated pump.

* * * * *